US007112735B2

(12) United States Patent
Shire

(10) Patent No.: US 7,112,735 B2
(45) Date of Patent: Sep. 26, 2006

(54) MUSICAL WIND INSTRUMENT, VALVES THEREFOR, AND METHODS OF MANUFACTURING SAME

(75) Inventor: Stephen E. Shire, Hopedale, MA (US)

(73) Assignee: S.E. Shires, Inc., Hopedale, MA (US)

( * ) Notice: Subject to any disclaimer, the term of this patent is extended or adjusted under 35 U.S.C. 154(b) by 15 days.

(21) Appl. No.: 10/862,816

(22) Filed: Jun. 7, 2004

(65) Prior Publication Data

US 2005/0016356 A1 Jan. 27, 2005

Related U.S. Application Data

(60) Provisional application No. 60/475,968, filed on Jun. 6, 2003.

(51) Int. Cl.
*G10D 7/10* (2006.01)

(52) U.S. Cl. ..... 84/395; 84/390

(58) Field of Classification Search ..... 84/390, 84/395

See application file for complete search history.

(56) References Cited

U.S. PATENT DOCUMENTS

| | | | | |
|---|---|---|---|---|
| 5,919 A | | 11/1848 | Paine | |
| 4,112,806 A | | 9/1978 | Thayer | |
| 4,127,052 A | | 11/1978 | Thayer | |
| 4,213,371 A | | 7/1980 | Thayer | |
| 4,299,156 A | | 11/1981 | Thayer | |
| 4,469,002 A | | 9/1984 | Thayer | |
| 4,905,564 A | * | 3/1990 | Thayer | 84/390 |
| 5,396,825 A | * | 3/1995 | Kirts | 84/390 |
| 5,686,678 A | | 11/1997 | Greenhoe | |
| 5,965,833 A | * | 10/1999 | Lindberg | 84/390 |

OTHER PUBLICATIONS

Webpage, Selmer & Bach News Releases, "New Hagmann Valve for Trombones Offered by The Selmer Company," Jun. 2000, (2 pages).

Webpage, The René Hagmann® Free-Flow Rotary Valves, visited Jun. 2004, (1 page).

* cited by examiner

*Primary Examiner*—Marlon T. Fletcher
*Assistant Examiner*—Jianchun Qin
(74) *Attorney, Agent, or Firm*—TraskBritt, PC

(57) ABSTRACT

A valve for use in musical wind instruments, associated musical instruments, and methods of fabricating such valves and musical instruments are provided. An exemplary rotor valve includes a solid rotor body having a first, substantially straight passage defined therein extending from a first opening in a peripheral surface of the rotor body to a second opening in the peripheral surface. Second and third passages are formed and extend from associated openings in the peripheral surface to associated openings in a face surface of the rotor body. The first passage may define a first, primary flow path of the instrument and the second and third passages cooperatively define a second flow path of the instrument, which incorporates an added length of tubing. In one embodiment, an interchangeable tube insert may be installed in the first passage to define flow characteristics in the first flow path.

24 Claims, 9 Drawing Sheets

MUSICAL WIND INSTRUMENT, VALVES THEREFOR, AND METHODS OF MANUFACTURING SAME

CROSS-REFERENCE TO RELATED APPLICATIONS

This application claims the benefit of U.S. Provisional Application Ser. No. 60/475,968, filed Jun. 6, 2003, the disclosure of which is incorporated by reference herein in its entirety.

BACKGROUND OF THE INVENTION

1. Field of the Invention

The present invention relates generally to musical instruments and, more particularly to musical instruments conventionally termed brass musical instruments, and to valves for use with such musical instruments.

2. State of the Art: The term "brass musical instrument" is used herein in its conventional usage in the art, to denote a musical instrument that defines a length of tubing, and which has at one end a "cup mouthpiece" to receive a player's lips and has at the other end a flared opening or bell from which the sound emerges. The sound is generated when a player vibrates their lips and, simultaneously, forces air through the mouthpiece, the length of tubing and out the bell. As is well known, such so-called "brass musical instruments," while often being made of various metals, including brass, are also known to be made in whole or in part of other materials, including fiberglass, plastics, carbon fiber, etc.

Conventional brass musical instruments that are constructed to be at least in part chromatic, or to play notes other than those found in the harmonic overtone series of the basic flow path defined by the instrument, include mechanisms for effectively changing the length of the tubing within the instrument through which a vibrating column of air generated by the player's lips passes. By changing the length of the tubing, a different harmonic overtone series is established that allows the generation of additional notes. Conventionally, the length of tubing may be changed by either of two primary mechanisms. A first mechanism, as used in a modern trombone is through use of an easily moveable slide, through which the length of the tube may be changed as desired by the player to facilitate the playing of all notes in a scale. The second mechanism is through the use of valves, which are selectively actuated to change the length of tubing. In modern instruments, the actuation of a valve alters the flow path of the instrument to add a given length of tubing which is sufficient to lower the harmonic series a given increment, or number of notes. Some instruments may include multiple valves for adding multiple lengths of tubing to a flow path of the instrument. For example, a modern instrument that is intended to be chromatic may include three valves, wherein the first valve lowers the harmonic series, by two steps or chromatic notes, the second valve lowers the harmonic series by a single step or note, and the third valve lowers the harmonic series by 3 chromatic steps or notes.

The environment of the present invention will be discussed primarily in reference to instruments of the trombone family, where the primary pitch adjustment mechanism is through use of a moveable slide, because that is an exemplary application in which the present invention is believed to have particular utility. However, instruments in accordance with the present invention may also include any valved instrument.

Trombones in their simplest form have a slide as their pitch adjustment mechanism. Because of the length of the slide relative to the overall length of the tubing of the instrument, trombones typically have a primary air path in which the air column changes direction only twice, reversing direction at the bottom of the slide, and again behind the player's head, to turn toward a forward-facing bell. Due to the limited turns, and the gradual nature of those turns, trombones offer a very free path for the movement of an air column through the tubing. In general, the contours of the internal path through a brass musical instrument, or the bore of the instrument, in large part define the playing characteristics of that instrument to the player. Bends or alterations of the bore can introduce varying degrees of resistance to movement of the air column being transmitted through the instrument. Such resistance can ultimately introduce undesirable playing characteristics in the instrument.

As noted above, for practical reasons it is desirable for many trombones to also include one or more valves, which may be used to add an additional length of tubing to the air path thereby providing an alternate way in which the pitch of the instrument may be varied. For example, changes between notes played with the slide fully extended, in what is known as the "seventh position," to a note played with the slide fully retracted, in what is known as the "first position," may be difficult, if not impossible, to play quickly and accurately. A valve that adds additional tubing to the airpath can dramatically improve the dynamics and mechanics of playing such changes in notes. Additionally, the lowering of the pitch of the shortest tube of the instrument also extends the bottom range of the instrument, relative to an instrument without the valve and additional tubing. Thus, depending upon the player's preferences and needs, it is common for trombones to have one or more valves. Where, for example, two valves are included, there are several known configurations as to how much tubing is added, and whether the two valves may be operated to add tubing independent of, or in conjunction with, one another. However, these variations in valve combinations are well known in the art, and any of them may benefit from the present invention.

Trombones, because of the relatively free air path provided through the basic instrument, are often viewed as being highly sensitive to structures that provide obstructions to air flow though the bore. As can be envisioned, trombones offer a much more open path than an instrument that is coiled into a more compact shape, such as euphoniums and tubas, which require many bends to achieve their conventional shapes. Conventional rotary valves, which are often used in trombones, add tubing (i.e., lengthen the flow path) by rotating between two positions, including an unactuated position in which the air flows through the valve in a generally longitudinal, but somewhat deviated or curved path, and an actuated position, wherein the valve causes the bore to make a 90° bend into the valve tubing, through the tubing, which will inherently reverse direction to return to the valve and through another 90° bend in the valve to return to the primary bore. Such a construction, however, conventionally requires that one of the 90° bends be used in defining the primary flow path thereby introducing flow inefficiencies even when the valve is in an unactuated position.

Many constructions of valves of this general type have been built. In some cases, the pathway is defined through the valve rotor merely by a hollowed section in a generally solid body—such a hollowed section conventionally exhibiting a cross-sectional area, which might be defined as a "D" shape, when the rotor is placed in a corresponding valve housing. Clearly, such a mismatch in cross-sectional geometry (i.e., a "D" shape as compared to the conventional circular cross section of a tube or bore of the musical instrument) is inefficient in transferring air through the mismatched sections. In other cases, tubes have been assembled within a generally cylindrical housing to define the air passages. Whatever the precise construction utilized in the rotor, the bends required to turn the airstream 90° introduce resistance, which is typically undesirable to the player.

Thus, depending upon the precise configuration of the opening defined through the valve, resistance may be induced even in the primary bore when the valve is unactuated, due to a passage through the valve that is not straight, or which is not a perfectly matched cross-sectional extension of the tubing bore coming into and exiting the valve. Additionally, the configuration of various prior art valves may allow substantial leakage through the valve when subjected to air pressures present during playing conditions. Such leakage may be, for example, because of loose tolerances within the valve due to the variability experienced in manufacturing the valve. Therefore, the greater the variability in manufacturing processes from one process to another, the more leakage may be expected. Of course, leakages in a valve will typically induce undesirable playing characteristics compared to an instrument having a simple basic tube design without a valve (e.g., a trombone having only a tube and slide design).

For these reasons, several attempts have been made to design valves useful in trombones and other instruments that would reduce the impact on the playing characteristics of the instrument while in an unactuated position and/or the actuated position. While offering some advantages, these designs have had offsetting characteristics. One example of such an attempt is found in U.S. Pat. No. 4,905,564 to Thayer. This design includes a frusto-conical valve with passages extending generally in the direction of the axis of rotation of the valve, though angularly disposed relative to such axis. While this design reduced restrictions in the flow path to some degree, it results in a very large valve, with large surface area between the valve body and housing. As a result of the large volume of the valve, the valve bodies are conventionally constructed of separate tubing (to define the passages through the valve) and other components, so as to reduce the mass of the valve body to allow rapid operation of the valve. This leads to undesirable complexity and variability in the manufacturing process. Additionally, regardless of whether individual tubing components are used in order to reduce the mass of the valve rotor or if a rotor body is formed as a cast member, the size of the valve requires the rotor to be displaced through an undesirably large arc to effect actuation thereof.

Another attempt to address some of the deficiencies of use of conventional rotary valves in trombones was a valve design known as the Hagmann valve. A valve rotor 10 of an exemplary Hagmann valve is depicted in FIGS. 1A–1C. The Hagmann valve rotor 10 includes a frame 12 which defines an outer periphery of the rotor 10. A shaft 14 is coupled to the frame 12 to rotate the rotor 10 about a longitudinal axis of the shaft 14. A first section of tubing 16 is disposed within the frame 12 and is coupled with a first opening 20 in the radial periphery of the frame 12 and a second opening 22 in the radial periphery of the frame 12 to define a flow path therebetween. A second section of tubing 24 is disposed within the frame 12 and is coupled with a third opening 26 in the radial periphery of the frame 12 and a first opening 28 in a face plate 30 or wall of the frame 12 to define a flow path therebetween. A third section of tubing 32 is disposed within the frame 12 and is coupled with a fourth opening 34 in the radial periphery of the frame 12 and a second opening 36 in the face plate 30 of the frame 12 to define a flow path therebetween. The faceplate 30 lies in a plane that is substantially perpendicular to the axis of rotation of the rotor 10. It is noted that each of the sections of tubing 16, 24 and 32 are bent or curved, causing a deviation in the flow path of any air transmitted therethrough during the playing of an associated instrument.

Referring to FIGS. 1D and 1E, the valve rotor 10 is shown in an unactuated position (FIG. 1D) and in an actuated position (FIG. 1E), wherein the rotor 10 is rotated about an axis extending through the shaft 14 through a specified angle of rotation. While a valve housing is not shown for purposes of clarity, those of ordinary skill in the art will recognize that such a housing is used in conjunction with the rotor 10 to cooperatively define a flow path for the vibrating air being transmitted through the associated instrument depending on which position the rotor 10 is in at a given time. Thus, for example, with the rotor 10 in an unactuated position, the first opening 20 in the radial periphery of the rotor frame 12 is aligned and in communication with an inlet tube 40 (shown in phantom) and the second opening 22 in the radial periphery of the rotor frame is aligned and in communication with an outlet tube 42 (also shown in phantom). Thus, air is transmitted from the inlet tube 40, through the first section of tubing 16 and to outlet tube 42 as indicated by directional arrows 44, 46 and 48. The transmitted air travels through the outlet: tube 42 and, ultimately, passes through a bell (not shown) to emit a musical note as discussed hereinabove.

Referring to FIG. 1E, when the rotor 10 is in the actuated position, the third opening 26 in the radial periphery of the rotor frame 12 is aligned with the inlet tube 40 and the fourth opening 34 in the radial periphery of the rotor frame 12 is aligned with the outlet tube 42. Additionally, the first opening 28 in the face plate 30 becomes aligned with first end 50 of an extension loop 52 and the second opening 36 in the face plate 30 becomes aligned with a second or return end 54 of the extension loop 52. Thus, air is transmitted from the inlet tube 40 (directional arrow 60), through the second section of tubing 24 to the extension loop 52 (directional arrow 62), through the extension loop to the third section of tubing 32 (directional arrows 64, 66 and 68), and through the third section of tubing 32 to the outlet tube 42 (directional arrows 70 and 72). The air is then transmitted through the outlet tube 42 (directional arrow 74) having gone through an extended length of tubing to change the pitch of the instrument as discussed hereinabove.

As with other conventional valves, the rotor of the Hagmann valve is constructed by manufacturing and assembling numerous individual components, including the frame and individual tubing sections 16, 24 and 32, which define the passages through the valve and subsequent assembly thereof. As discussed hereinabove, this leads to undesirable complexity and variability in the manufacturing process and ultimately to variability in the performance of the valve and instrument in which it is installed. Additionally, the rotor of the Hagmann valve has a shaft coupled to only one side of the housing, which introduces the possibility of the rotor "wobbling," or experiencing eccentricity, as it rotates about the shaft. Such deviation, whether occurring initially or over time, because of wear or other mechanical or material deterioration of the rotor, can cause misalignment and unneeded restrictions in the flow path as, for example, the flow path transitions between a section of tubing (e.g., 16, 24 or 32) to an associated inlet, outlet or return tube.

It is, therefore, desirous to provide an improved valve for musical instruments that provides at least one flow path that does not introduce substantial resistance to air transmitted therethrough, which is simple and economical to manufacture. It is also desirable to provide an improved valve for musical instruments that is able to be reproduced without substantial variation from one product to the next.

BRIEF SUMMARY OF THE INVENTION

In accordance with one aspect of the invention a valve assembly for use in a musical wind instrument is provided. The valve assembly includes a valve housing having a substantially cylindrical side wall and a face wall coupled with the side wall. An inlet port and an outlet port are formed in the side wall. An extension loop entrance port and an extension loop return port are formed in the face wall. The valve assembly further includes a valve rotor comprising a solid body having a substantially straight first passage defined therein. A tubular insert may be disposed in the first passage. Second and third passages are also defined therein, the second and third passages each extending from openings in a substantially cylindrical peripheral surface of the solid body to openings in a face surface of the solid body. The valve assembly further includes an actuator coupled with the valve rotor configured to displace the solid body between a first position, wherein the first passage is aligned with the inlet port and the outlet port, and a second position, wherein the second passage is aligned with the extension loop entrance port and the third passage is aligned with the extension loop return port.

In accordance with another aspect of the present invention, a valve rotor for use in a valve of a musical wind instrument is provided. The valve rotor includes a solid body having a substantially straight first passage defined therein, a second passage defined therein, and a third passage defined therein. The first passage extends from a first opening in a substantially cylindrical peripheral surface of the solid body to a second opening in the peripheral surface. A tubular insert may be disposed in the first passage. The second passage extends from a third opening in the peripheral surface to a first opening in a face surface of the solid body. The third passage extends from a fourth opening in the peripheral surface to a second opening in the face surface.

In accordance with yet another aspect of the present invention, a musical instrument is provided. The musical instrument includes a first length of tubing defining a first air path, the first length of tubing extending between first and second ends, and a second length of tubing defining a second air path, the second length of tubing extending between first and second ends. The musical instrument further includes a valve assembly in accordance with certain aspects of the present invention, such as described hereinabove. An actuator may be coupled with the valve assembly and configured to displace a valve rotor between a first position wherein the first air path is active and a second position wherein the second air path is active.

In accordance with yet a further aspect of the present invention, a method is provided for forming a valve rotor for use in a valve assembly of a musical wind instrument. The method includes forming a solid body having a substantially cylindrical outer peripheral surface and a face surface. A substantially straight passage is formed in the solid body, such that it extends from a first opening in the peripheral surface to a second opening in the peripheral surface. A tubular insert may be disposed in the first passage. A second passage is formed in the solid body such that it extends from a third opening in the peripheral surface to a first opening in the face surface. A third passage is also formed in the solid body, such that it extends from a fourth opening in the peripheral surface to a second opening in the face surface.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1A:
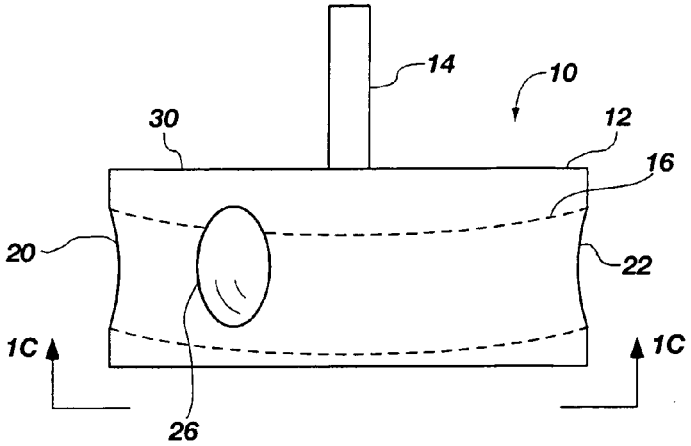
FIG. 1A (PRIOR ART)
FIGS. 1A–1E show various views of a prior art valve used with musical instruments.
Figure 1B:
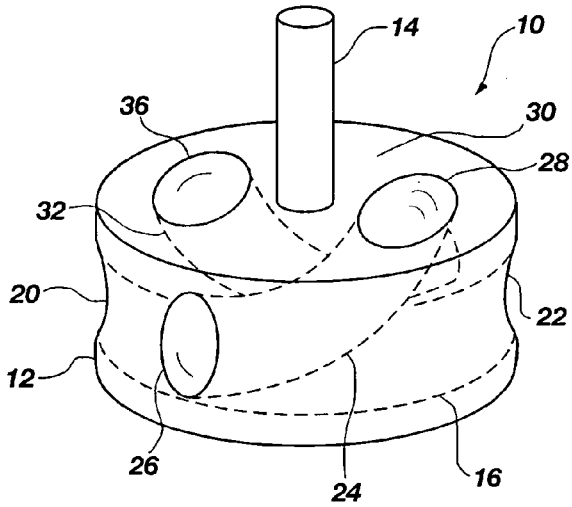
FIG. 1B (PRIOR ART)
Figure 1C:
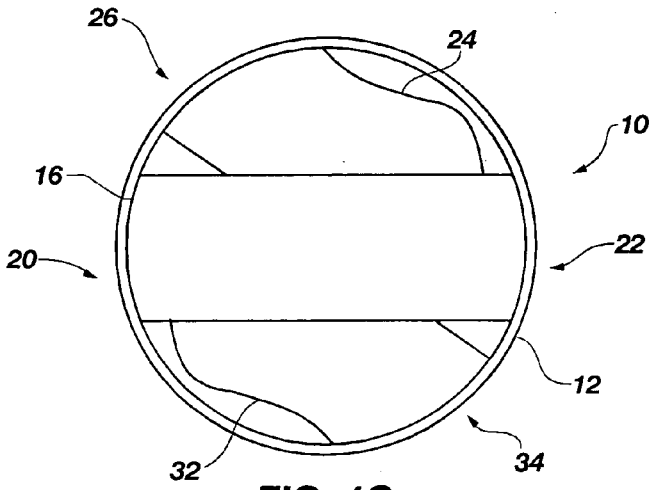
FIG. 1C (PRIOR ART)
Figure 1D:
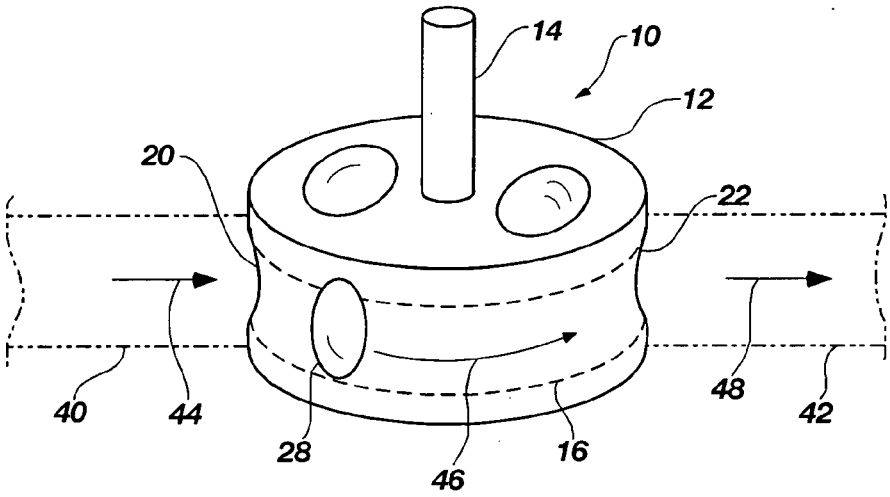
FIG. 1D (PRIOR ART)
Figure 1E:
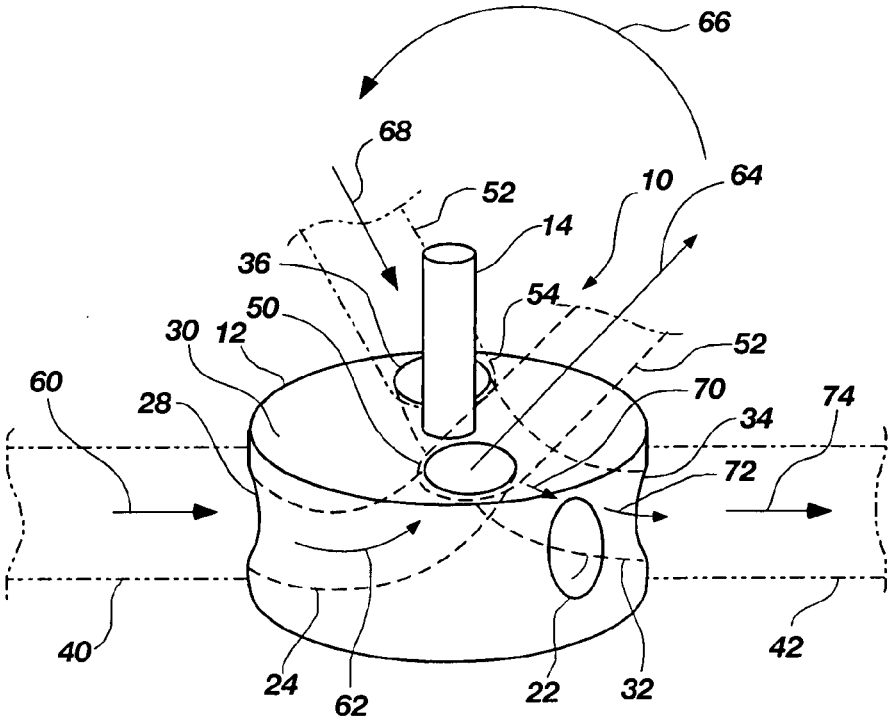
FIG. 1E (PRIOR ART)
Figure 2A:
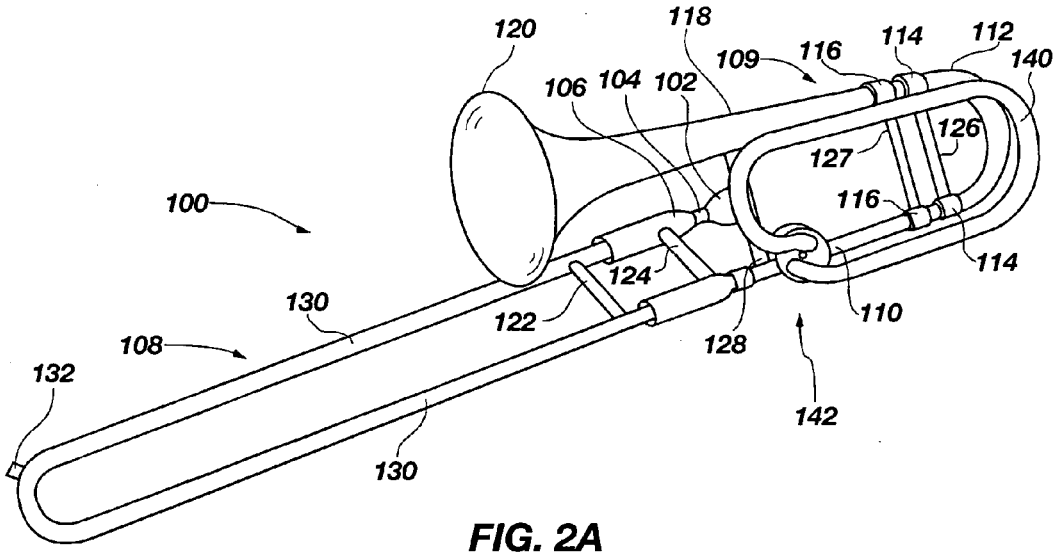
FIG. 2A is a perspective view of an exemplary musical instrument in accordance with an embodiment of the present invention.

Referring to FIG. 2A, an exemplary musical instrument 100 is shown in the form of a trombone. As previously noted, while a trombone is discussed as the exemplary musical instrument 100, other instruments may be constructed in accordance with principles of the present invention.

The instrument 100 includes a mouthpiece 102 having a stem 104 fitted into a receiver 106. The receiver 106 is coupled to a variable length telescoping hand slide section 108, which is further coupled to a bell section 109. The bell section 109 comprises a tube 110, a tubular tuning slide bow 112, unions 114 and receivers 116, a tubular bell throat 118 and a bell flare 120. Various braces 122 and 124 are coupled to portions of the hand slide section 108 for maintaining the structural and geometric configuration of the hand slide section 108, as well as for accommodating a player's hands while playing the instrument 100. Similarly, braces 126, 127 and 128 are coupled to portions of the bell section 109.

The hand slide section 108 includes a pair of outer slide tubes 130, which have inner cross-sectional geometries and dimensions that cooperatively mate with inner slide tubes (not shown in FIG. 2A, but disposed interiorly of the outer slide tubes 130 as will be recognized by those of ordinary skill in the art). The outer slide tubes 130 are configured for telescopic displacement relative to the inner slide tubes, so as to change the effective length of the air path between the mouthpiece 102 and the bell flare 120 and thereby change the musical pitch emanating from the bell flare 120. The hand slide section 108 may also include a water key 132, sometimes referred to as a spit valve, which may include a spring loaded valve associated with a port in the hand slide section 108 for emptying spit, water, or other lubricant, as will be appreciated by those of ordinary skill in the art.

The instrument 100 further includes an extension loop 140 and a valve 142 that is configured to selectively incorporate or exclude the extension loop 140 from the air path defined between the mouthpiece 102 and the bell flare 120. Thus, when the valve 142 is in a first position, the air path is defined to proceed directly from the hand slide section 108 to the bell section 109 and when the valve 142 is in a second position, the air path is defined to proceed from the hand slide section 108, through the extension loop 140, and then through bell section 109. The inclusion of the extension loop 140 in the flow path changes the effective length of the flow path, enabling a change in the fundamental musical pitch or key of the instrument. Inclusion of such a valve 142 and extension loop 140 provides a player of the instrument 100 with extended range and added flexibility in playing the instrument 100.

Figure 2B:
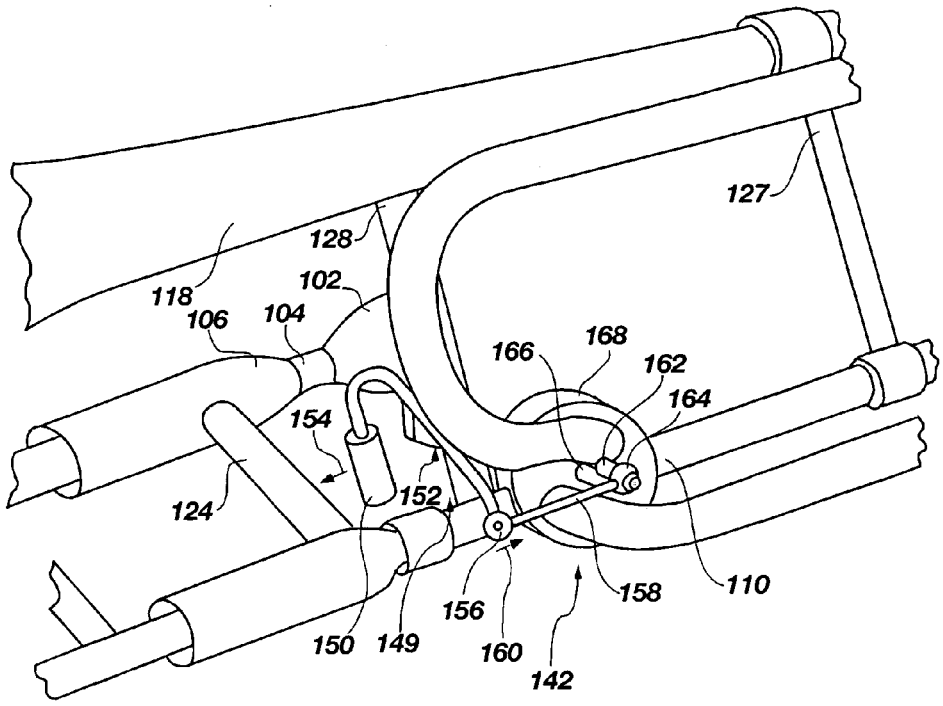
FIG. 2B is an enlarged view of a portion of the instrument shown in FIG. 2A.

Referring to FIG. 2B, an enlarged view of a portion of the instrument 100 is shown wherein additional detail of the valve 142 may be seen. The valve includes an actuating mechanism 149 having an actuator lever 150 coupled to a biased fulcrum 152. The fulcrum 152 enables the lever 150 to be displaced in a first direction, as indicated by directional arrow 154, and subsequently return to its original position by virtue of, for example, a spring (not shown), which provides a bias to the fulcrum 152. The actuator lever 150 is also coupled with a pivoting link 156. When the actuator lever 150 is displaced, a pivoting link 156 causes displacement of a linkage member 158 coupled therewith in a direction indicated by directional arrow 160. The linkage member 158 is coupled to an offset linkage member 162 by way of another pivoting link 164. The offset linkage member 162 is coupled to a spindle collar 166, such that displacement of the offset linkage member 162 causes rotation of the spindle collar 166 and, ultimately, rotation of a valve rotor (not shown in FIG. 2B) disposed within the valve housing 168.

It is noted that, while the exemplary instrument 100 is shown and described as having a single valve 142 and a single extension loop 140, other embodiments may include multiple valves and multiple extension loops. Thus, for example, a second valve may be configured to selectively incorporate or exclude a second extension loop, either in combination with, or independent of, incorporation of the first extension loop 140.

Figure 3:
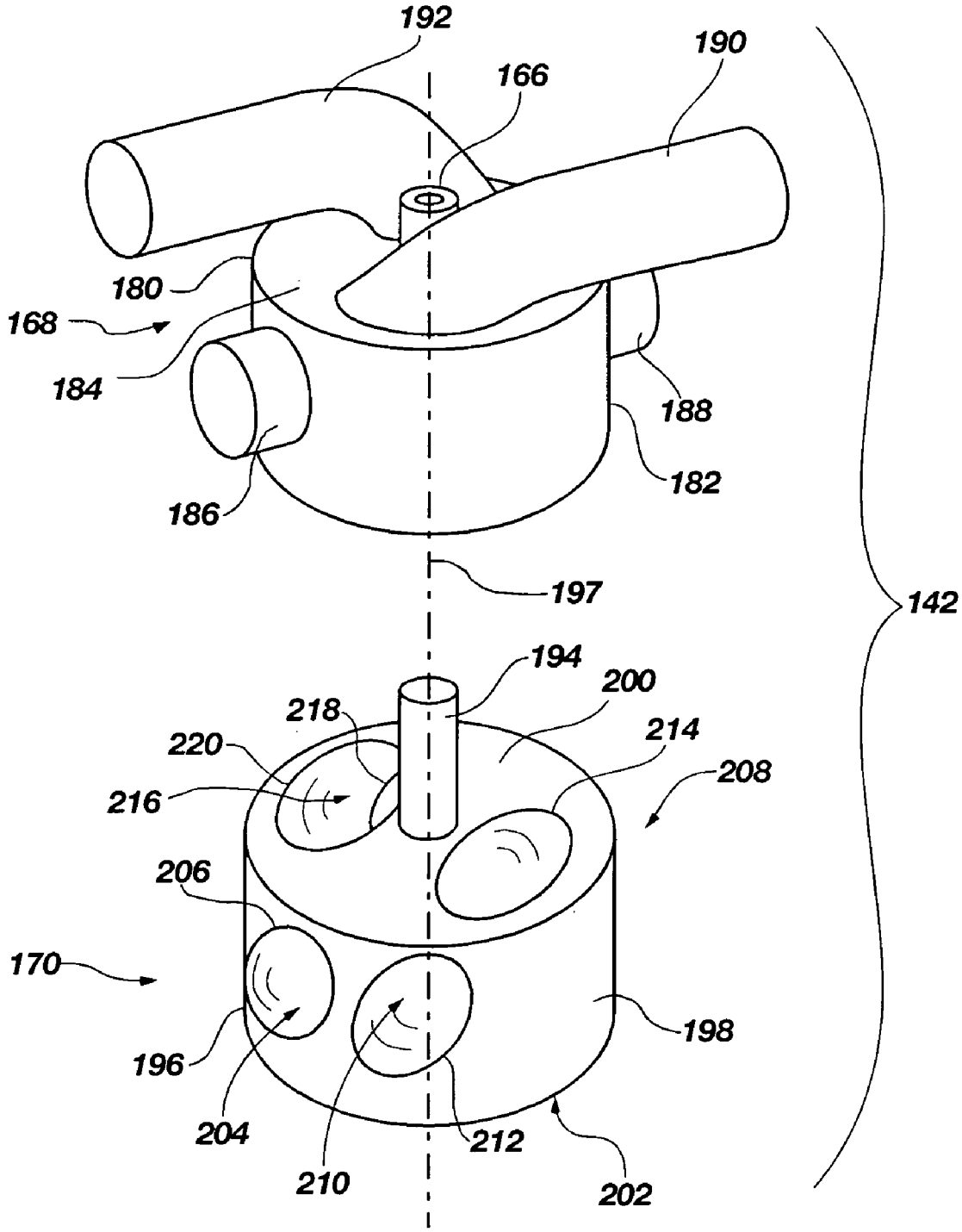
FIG. 3 is an exploded perspective view of an exemplary valve in accordance with an embodiment of the present invention.

Referring now to FIG. 3, an exploded view of an exemplary valve 142 is shown. The valve 142 generally includes the valve housing 168 and a valve rotor 170. The valve housing 168 includes an outer casing 180 defined by an outer side wall 182 and a face wall 184. An inlet port 186 and an outlet port 188 are each formed in the side wall 182 to provide communication between the valve 142 and various components of the instrument 100 (e.g., the hand slide section 108 and the bell section 109 shown in FIG. 2A). An extension loop entrance port 190 and an extension loop return port 192 are formed in the face wall 184 to provide communication between the valve 142 and the extension loop 140 (FIGS. 2A and 2B). The spindle collar 166 is rotatably coupled with the face wall 184 and is configured to be coupled with the shaft 194 of the valve rotor 170 as shall be further described hereinbelow.

The valve rotor 170 includes a first shaft 194, which is rigidly coupled with the rotor body 196 and which defines an axis of rotation 197. As will be discussed in further detail hereinbelow, a second, coaxial shaft may be coupled to the rotor body 196 on a surface opposite to that of the first shaft 194. In one embodiment, the rotor body 196 comprises a solid mass of material, such as, for example, aluminum, although other materials are contemplated as being utilized. Additionally, in one exemplary embodiment, the rotor body 196 may be coated, plated or otherwise treated. For example, an aluminum rotor body 196 may be plated with an electroless nickel, anodized or include some other hard coating. The rotor body 196 is configured to be cooperatively received into the interior of the valve housing 168. Thus, the rotor body is defined by an outer side surface 198 and a face surface 200. In one exemplary embodiment, and as shown in FIG. 3, the outer side surface 198 may be formed to exhibit a substantially cylindrical geometry. As used herein, the term "substantially cylindrical" may include deviations from truly cylindrical and even allows for tapering of the outer side surface 198 between the face surface 200 and an opposing surface 202.

A plurality of passages are formed in the rotor body 196. A first passage 204 is formed through the rotor body 196 penetrating the outer side surface 198 to define a first opening 206 and a second opening 208 (not expressly shown in FIG. 3) therein. In one embodiment, the first passage 204 is substantially straight with no substantial deviation between the first and second openings 206 and 208 thereof. In an exemplary embodiment, the first passage 204 may exhibit a substantially constant cross-sectional area (e.g., cylindrical) throughout the passage as taken perpendicular to a longitudinal axis thereof. Additionally, in one exemplary embodiment, the first passage is oriented substantially perpendicular to; and passing through, the axis of rotation 197, although other orientations are contemplated. As discussed in further detail below, the first passage 204 may act as a primary air path of the valve 142 having substantially no obstructions and defining a substantially unimpeded flow path when the valve 142 is in a first position.

A second passage 210 is defined within the rotor body 196 penetrating the outer side surface 198 to define a first opening 212 of the passage 210, and penetrating the face surface 200 to define a second opening 214 of the passage 210. The second passage exhibits a geometry that is curved about an axis that is substantially perpendicular to the axis of rotation 197 and also curved about an axis that is substantially parallel to the axis of rotation 197. The overall curvature of the second passage 210 may be desirably maximized to provide a relatively smooth transition in the flow path partially defined thereby and to reduced turbulence in any airflow passing therethrough. In one embodiment, the second passage may exit the rotor body 196 at an angle between approximately 45° and approximately 75° as measured relative to a plane that is perpendicular to the axis of rotation 197. In one exemplary embodiment, the angle is approximately 65° degrees A third passage 216 is defined within the rotor body 196 penetrating the outer side surface 198 to define a first opening 218 of the passage 216 and penetrating the face surface 200 to define a second opening 220 of the passage 216. The third passage 216 exhibits a geometry that is curved about an axis that is substantially perpendicular to the axis of rotation 197 and also curved about an axis that is substantially parallel to the axis of rotation 197. The overall curvature of the third passage may be desirably maximized to provide a relatively smooth transition in the flow path partially defined thereby and to reduced turbulence in any airflow passing therethrough. In one embodiment, the third passage 216 may be configured substantially the same as, and symmetric about the axis of rotation 197 with, the second passage 210.

In one exemplary embodiment, a valve rotor 170 used in conjunction with a bass trombone may exhibit an overall diameter of approximately 1.65 to approximately 1.70 inches with the bores of each of the passages 204, 210, 216 exhibiting a cross-sectional diameter of approximately 0.55 to approximately 0.625 inches. Of course, the dimensions of a given valve rotor 170 may vary depending, for example, on the type of instrument with which the valve will be used. Additionally, each of the passages need not exhibit the same cross-sectional area. For example, in some embodiments, it may be desirable to make the third passage 216 such that its bore exhibits a larger cross-sectional area than that of the second passage. In another embodiment, it may be desirable to form the second and third passages 210 and 216 to exhibit a different cross-sectional area that that of the first passage 204. For example, assuming a substantially circular cross section for each of the passages, the second and third passages 210 and 216 may be smaller or larger than the first passage 204 by an increment of approximately 0.005 inch or greater. Such tailoring of the passages enables the presentation or sound of the instrument to be customized to some degree depending on player preferences or intended use of the instrument 100.

It is noted that the inventor has determined that prior art valves, such as those conventionally formed of individual thin walled tubing components, do not project sound as well a valve having a rotor body 196 formed as a single piece or a solid member. Such prior art valves are considered to produce an unfocused sound. In contrast, the present invention is considered to produce a fuller sound, as the solid body rotor minimizes sound loss, effects greater blowing responsivity and greater sound projection to an audience. Similarly, the inventor has determined that a solid body rotor having an essentially straight and direct primary flow path results in lower air turbulence, improved blowing performance, responsivity, and less resistance in the first operating position than conventional prior art rotary valves.

Figure 4:
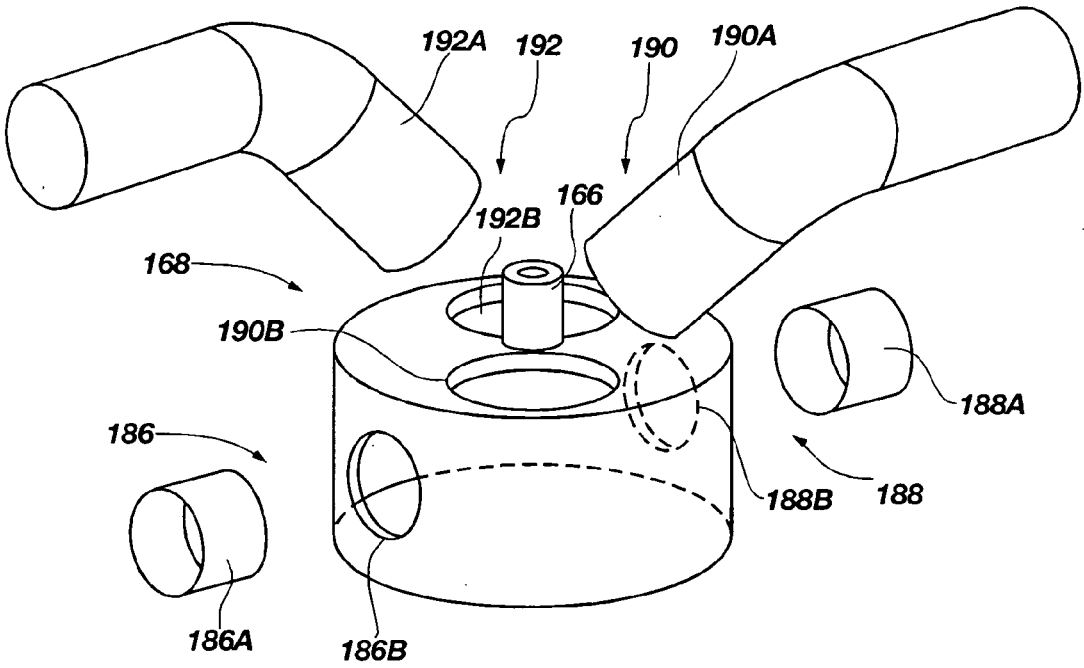
FIG. 4 is an exploded perspective view of a valve housing in accordance with an embodiment of the present invention.

Referring briefly to FIG. 4, an exploded view of an exemplary valve housing 168 is shown including the outer casing 180 (shown in FIG. 3), as defined by the outer side wall 182 and face wall 184, the inlet port 186, the outlet port 188, the extension loop entrance port 190, the extension loop return port 192 and the spindle collar 166. The inlet port 186 may include a tubing member 186A sealingly coupled to an opening 186B formed in the outer side wall 182. Likewise, the outlet port 188, the extension loop entrance port 190 and the extension loop return port 192 may each include appropriate tubing members 188A, 190A and 192A sealingly coupled to respective openings 188B, 190B and 192B formed in the outer casing 180. The various tubing members 186A–192A may be coupled to the respective openings 186B–192B, for example, by brazing, although other means of joining may be used, as will be appreciated by those of ordinary skill in the art. It is noted that the tubing members 190A and 192A associated with the extension loop entrance port 190 and the extension loop return port 192, respectively, may be configured to exhibit a substantially similar angle as that defined by corresponding second and third passages 210 and 216.

Figure 5:
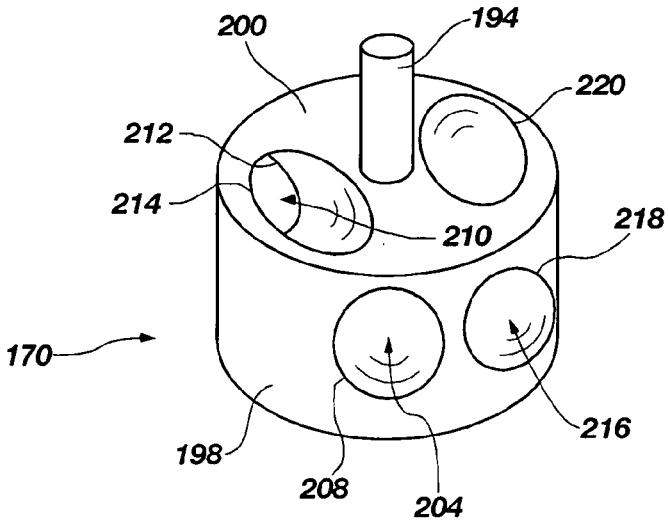
FIG. 5 is a rotated perspective view of the valve rotor depicted in FIG. 3.

Referring briefly to FIG. 5, the valve rotor 170 is shown rotated about the axis of rotation 197 (see FIG. 3) relative to the orientation shown in FIG. 3 in order to show the second opening 208 of the first passage 204 and to more clearly identify the first opening 218 of the third passage 216. The second passage 210, with its associated openings 212 and 214, is also shown.

Figures 6A, 6B:
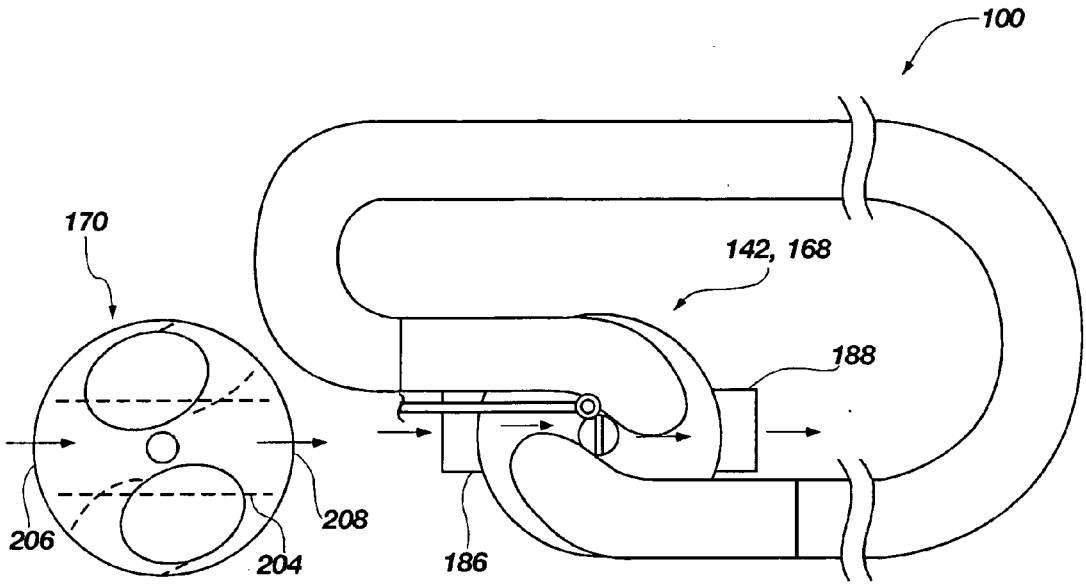
FIGS. 6A and 6B show a first valve rotor position and an instrument flow path associated with the first valve rotor position, respectively.

Referring now to FIGS. 6A and 6B, the flow path of the instrument 100 is shown while the valve rotor 170 is in a first position (e.g., an unactuated or resting position). When the valve rotor 170 is in the first, unactuated position, the first passage 204 is oriented such that its first and second openings 206 and 208 are aligned with the inlet port 186 and outlet port 188 of the valve housing 168, respectively. Thus, as air is transmitted to the inlet port 186, it travels through the first passage 204 of the valve rotor, which, in the exemplary embodiment, is straight and unobstructed, and to the outlet port 188, as indicated generally by the directional arrows. The unactuated position of the valve rotor 170, therefore, defines a primary flow path representing the fundamental musical pitch or tone of the instrument 100. The generally straight and unobstructed first passage 204 provides a flow path which renders a full and open sound emitting from the bell flare 120 (FIG. 2A). In other words, the valve rotor 170 of the presently described exemplary embodiment places an emphasis on providing a primary flow path that encounters as few obstructions or changes within the flow path as possible. Thus, with the valve rotor 170 in the unactuated position, the flow path is defined to be the same as if the instrument 100 included no valve at all.

Figures 7A, 7B:
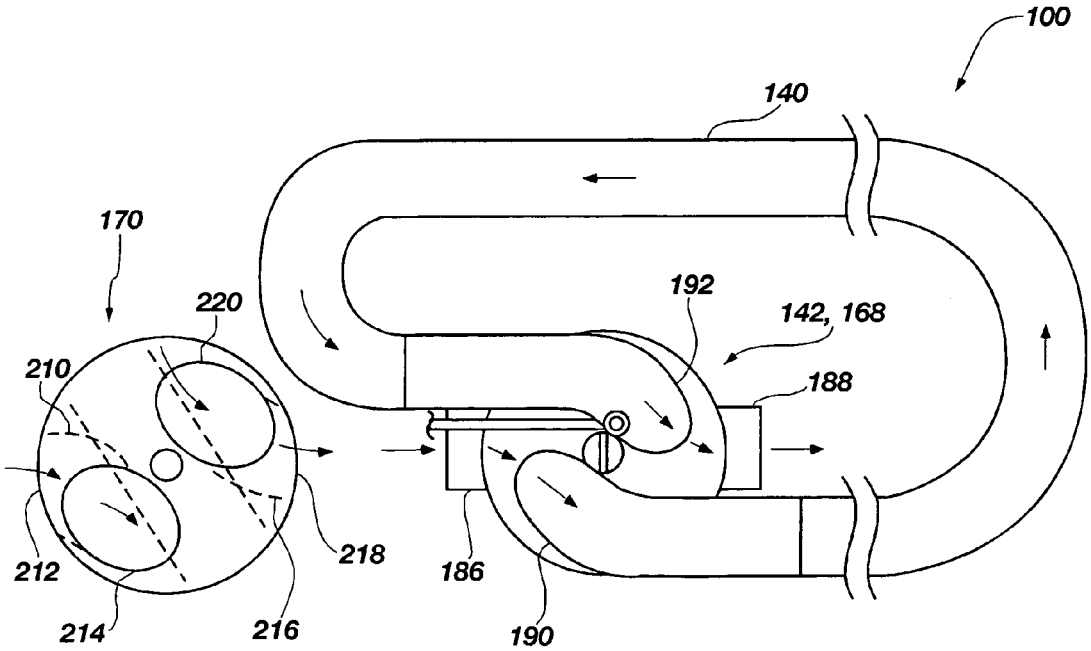
FIGS. 7A and 7B show a second valve rotor position and an instrument flow path associated with the second valve rotor position, respectively.

Referring to FIGS. 7A and 7B, the flow path of the instrument 100 is shown while the valve rotor 170 is in the second, or actuated, position. With the valve rotor 170 in the actuated position, the second passage 210 is oriented such that its first opening 212 is aligned with the inlet port 186 of the valve housing 168 and its second opening 214 is aligned with the extension loop entrance port 190. Additionally, the third passage 216 is oriented such that its first opening 218 is aligned with the outlet port 188 of the valve housing 168 and its second opening 220 is aligned with the extension loop return port 192. Thus, the flow path is defined such that air is transmitted through the inlet port 186, through the second passage 210 and into the extension loop 140, through the extension loop 140 to the third passage 216, and through the third passage to the outlet port 188, as generally indicated by the directional arrows. The actuation of the valve rotor 170, therefore, adds a desired length of tubing to the flow path thereby changing the musical pitch of the instrument as discussed hereinabove. It is noted that the second and third passages 210 and 216 of the valve rotor 170 are curved, thereby introducing some resistance into the flow path when the valve 142 is actuated. However, the maximization of the radius of curvature, including the curving of the passages 210 and 216 about two defined axes as described hereinabove, enables a relatively smooth transition within the flow path and minimizes the resistance that may be encountered by air transmitted therethrough.

The angle of rotation through which the valve rotor 170 rotates between the first, unactuated position (FIG. 6A) and the second, actuated position (FIG. 7A) is desirably relatively small so as to enable a quick and efficient actuation of the valve 142 by a player of the instrument 100. For example, in one embodiment, the angle of rotation is less than approximately 90°. In yet another exemplary embodiment, the angle of rotation may be defined to be approximately 61°. In a further embodiment, the angle of rotation may be as small as approximately 40°.

Figure 8:
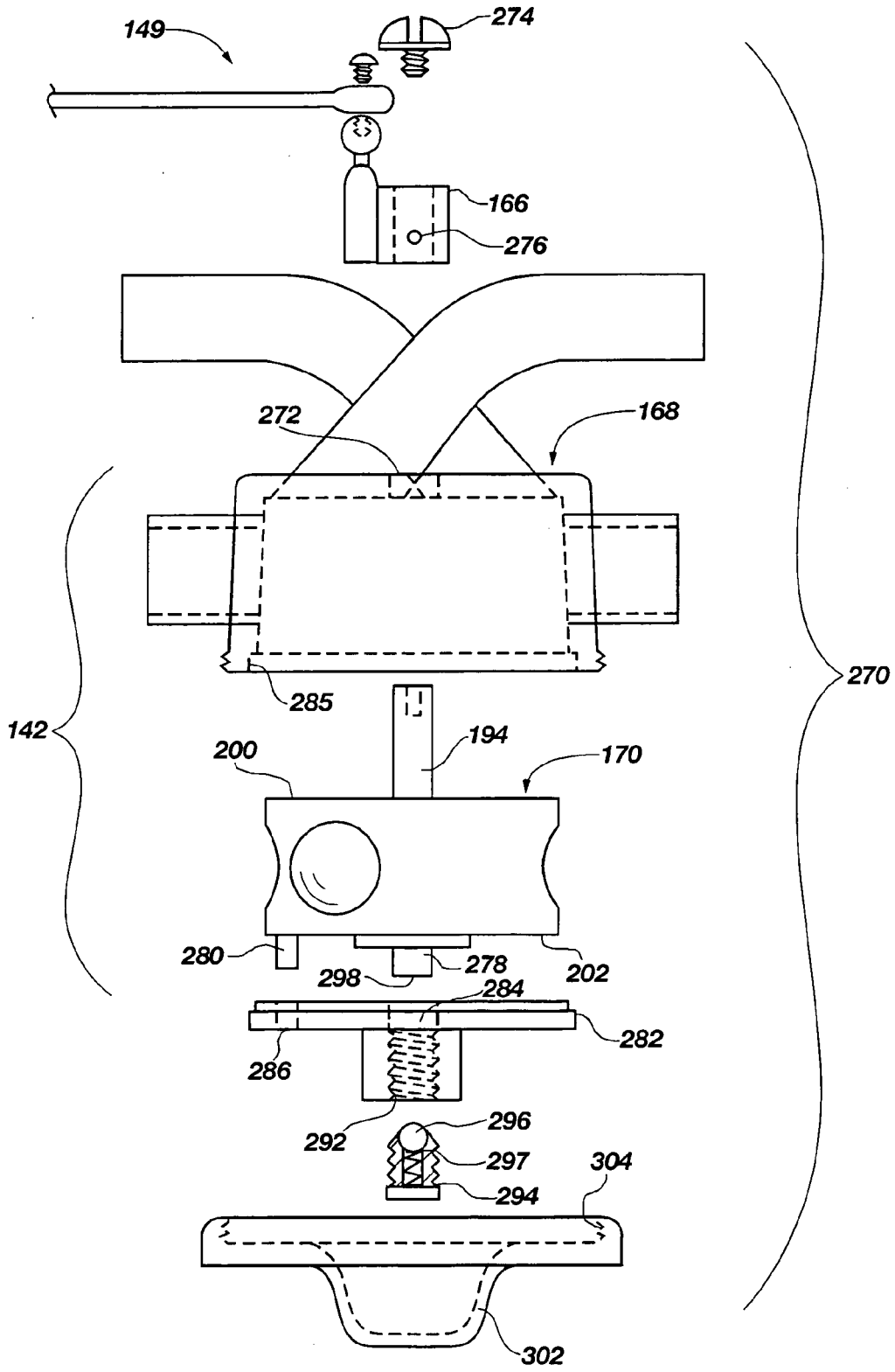
FIG. 8 is an exploded elevational view of a valve assembly in accordance with an embodiment of the present invention.

Referring now to FIG. 8, an exploded view of a valve assembly 270 is shown which includes the valve 142, the actuating mechanism 149 and additional components associated with the valve 142 for adjustment and control thereof. The shaft 194 of the valve rotor 170 extends through an opening 272 in the valve housing 168, which opening may include a bushing or bearing to assist in the rotation of the valve rotor 170 relative to the valve housing. The shaft is coupled to the spindle collar 166 of the actuating mechanism 149 by, for example, a top screw 274 and a set screw 276, although other fasteners or means of joining may be utilized.

Figure 9:
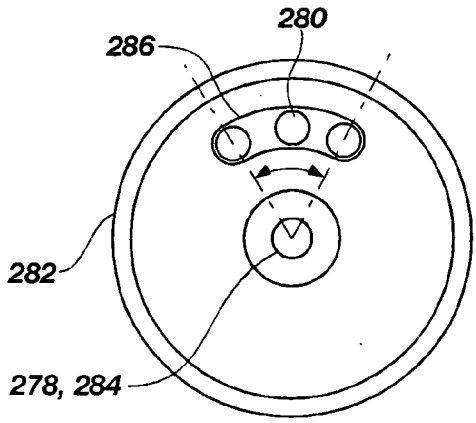
FIG. 9 is a plan view of various components of the valve assembly of FIG. 8 as assembled.

The valve rotor 170 also includes a second shaft 278 coupled with the surface 202 opposing the face surface 200 and which is coaxial with the first shaft 194. A stop member 280, such as a pin, is fixed to the opposing surface 202 such that it rotates in conjunction with the valve rotor 170 about the axis defined by the first shaft 194 and second shaft 278. A stop plate 282 is configured to receive a portion of the second shaft 278 in an opening 284 thereof. The opening 284 may also include a bushing or bearing to assist with relative rotation of the second shaft 278. The stop plate 282 is configured to fit within a bore 285 or shouldered recess defined in the valve housing 168. The stop plate 282 and bore 285 may be keyed or otherwise configured to prevent relative rotation of the stop plate 282 and the valve housing 168. The stop plate 282 also includes an arcuate channel 286 formed through a portion thereof and which is sized and configured to cooperatively receive the stop member 280 therethrough. As seen in FIG. 9, the arcuate channel 286 and stop member 280 may be cooperatively configured to define the angle of rotation a of the valve rotor 170. Thus, as the valve rotor 170 is rotated about its axis of rotation, the stop member 280 will abut the outer extents of the arcuate channel 286 to limit the rotation of the valve rotor 170.

Such a stopping arrangement provides direct feedback to a player regarding the positioning of the valve rotor 170, and also provides accurate positioning of the valve rotor 170 within the valve housing 168 to define a desired flow path. The direct feedback and positive stopping action is desirable over prior art stopping mechanisms which include, for example, blocks of cork or rubber that may be configured to interact with a component of the actuating mechanism to act as a stopping surface. Such prior art stopping surfaces can, over time, develop wear patterns causing the rotor to "stop" at a position that is less than optimal for alignment of the various ports and passages of the valve.

In one exemplary embodiment, the stop plate 282 and the stop member 280 may each be formed of a metal or metal alloy material. However, other materials, including rigid plastic materials may be used. In another embodiment, a small bumper, such as an o-ring, may be positioned on the stop member to provide a small cushion and, thus, quieter interaction, between the stop member and the outer extents of the arcuate channel 286 without substantially affecting the accuracy of the stopping arrangement.

It is noted that locating the arcuate channel 286 closer to an outer periphery of the stop plate 282 provides for increased accuracy and easier control of the stopping arrangement. Additionally, such a stopping arrangement may be combined with an actuating mechanism 149 having a small moment arm (the radial distance between the force-applying actuating linkage member 158 and the center of the first shaft 194), provides an efficient valve assembly requiring a short "throw" of the actuator lever 150 (FIG. 2B) and accurate stopping of the valve rotor 170.

Figure 10A:
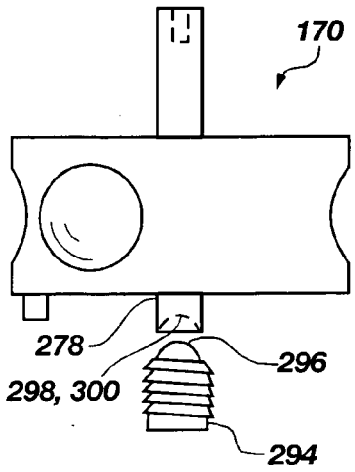
FIGS. 10A and 10B show details of various components of the valve assembly depicted in FIG. 8.
Figure 10B:
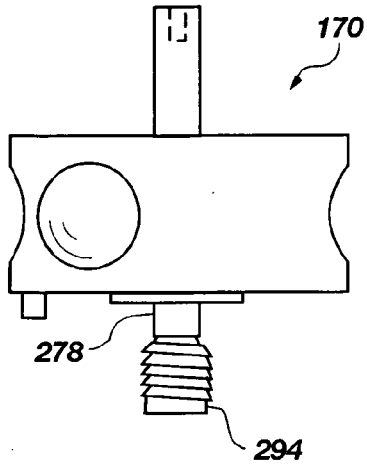

Referring back to FIG. 8, in one embodiment, the stop plate 282 may further include a collar 290 having internal threads 292 formed therein. An adjustment screw 294 is configured to matingly engage the collar 290. The adjustment screw 294 may include a ball 296 or other structural member disposed in an internal cavity of the adjustment screw, the ball 296 being biased by a spring 297 that is also disposed in the internal cavity of the adjustment screw 294. The biased ball 296 is configured to resistively abut an end surface 298 of the second shaft 278 and apply a desired amount of pressure thereto. Referring briefly to FIGS. 10A and 10B, in another embodiment, the ball 296 of the adjustment screw 294 may be configured to cooperatively mate with the end surface 298 of the second shaft 278. For example, a recess 300 or detent may be formed in the end surface 298 of the second shaft 278 to provide an increased amount of surface area for contact between the ball 296 of the adjustment screw 294 and the end surface 298 of the second shaft 278.

The adjustment screw 294 may work in cooperation with the valve rotor 170 and valve housing 168 to form a seal between the valve rotor 170 and valve housing 168. In one exemplary embodiment, the valve rotor 170 may exhibit a slight taper between the face surface 200 and the opposing surface 202. For example, the valve rotor 170 may exhibit approximately 0.005 to approximately 0.010 inch taper per longitudinal inch between the face surface 200 to the opposing surface 202. In one particular exemplary embodiment, the valve rotor 170 may exhibit approximately .020 inch taper per longitudinal inch between the face surface 200 to the opposing surface 202.

The interior cavity defined by the valve housing 168 may exhibit a mating tapered geometry. The biased ball 296 of the adjustment screw 294 effects seal by application of an unusually light sealing force and provides smooth, low friction valve operation in changing between the unactuated and actuated positions.

In another embodiment, the adjustment screw 294 may simply include a shaped end in place of the biased ball 296, such that tightening or loosening of the adjustment screw controls the amount of resistance applied to the end of the second shaft 278. In such an embodiment, the end of the adjustment screw may be configured for example, as a rounded end, a flat end, or shape to substantially mate with the end of the second shaft 278.

Figure 11:
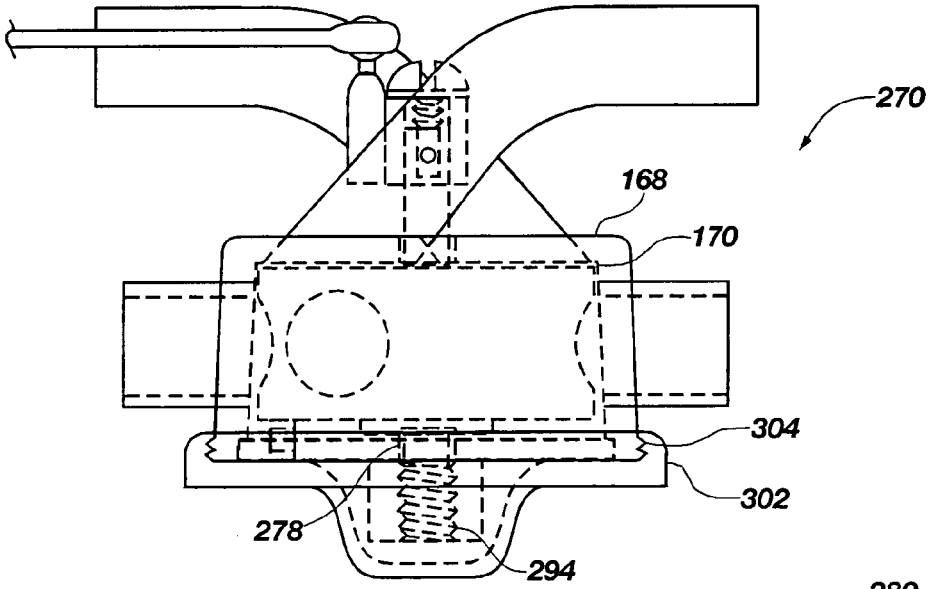
FIG. 11 shows an assembled view of the valve assembly of FIG. 8.

Referring to FIG. 11 while also referring to FIG. 9, when the valve assembly 270 is appropriately assembled, the interaction of the adjustment screw 294 with the second shaft 278 provides a mechanical resistance to the rotation of the valve rotor 170 within the valve housing 168. Thus, if a player desires the actuation of the valve rotor 170 to feel relatively firm or tight, the adjustment screw may be tightened to provide increased resistance. If, on the other hand, a player desires that the actuation of the valve rotor 170 have a light or loose feel to it, the adjustment screw 294 may be loosened, so as to decrease the resistance provided thereby. A cap 302 is configured to be removably coupled, such as by mating threads 304, to the valve housing 168 to maintain the valve assembly 276 in its assembled condition while allowing access to the valve rotor 170 and other components for cleaning and maintenance as may be desired.

Figure 12A:
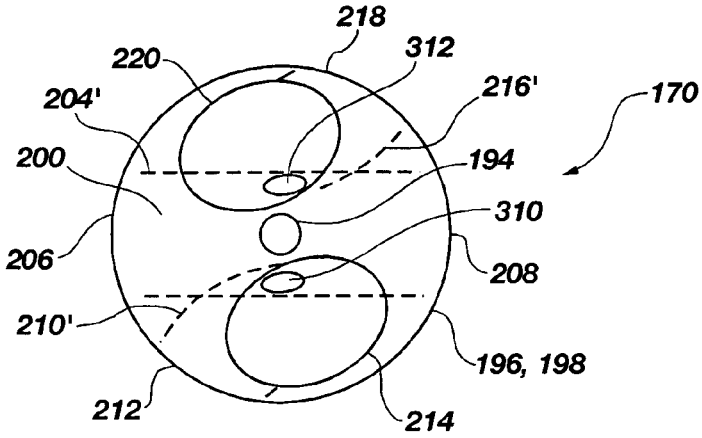
FIGS. 12A–12C show a plan view, a perspective view and a rotated perspective view of a valve rotor in accordance with another embodiment of the present invention.
Figure 12B:
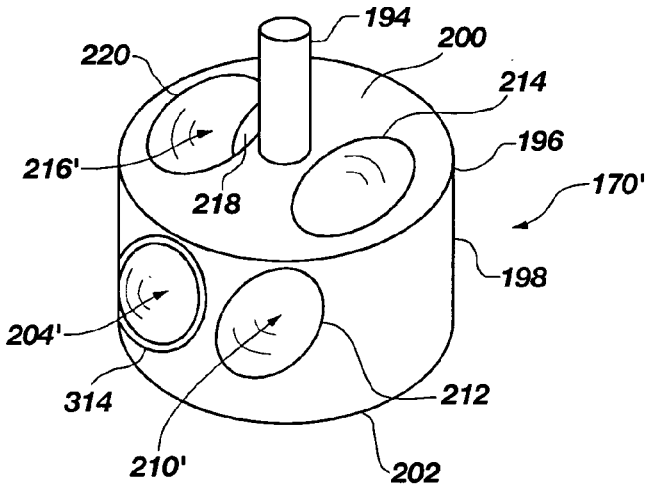
Figure 12C:
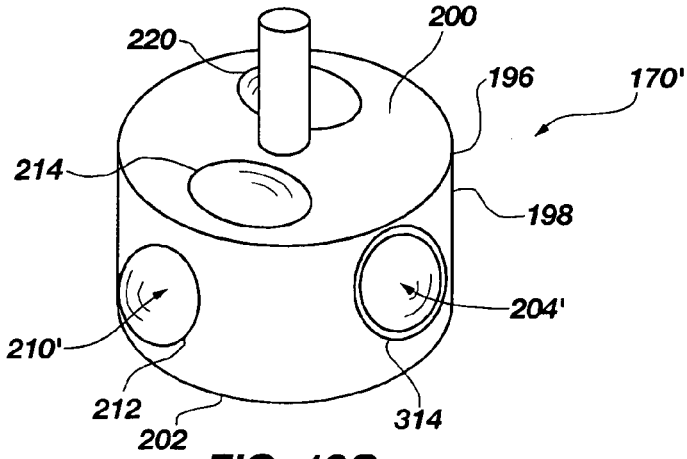
Figure 2B:
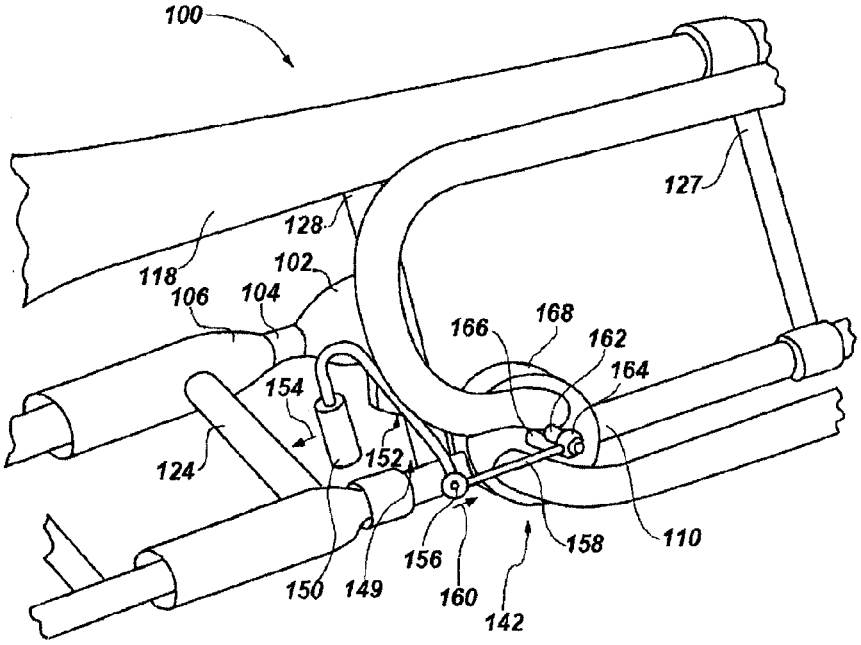
Figure 8:
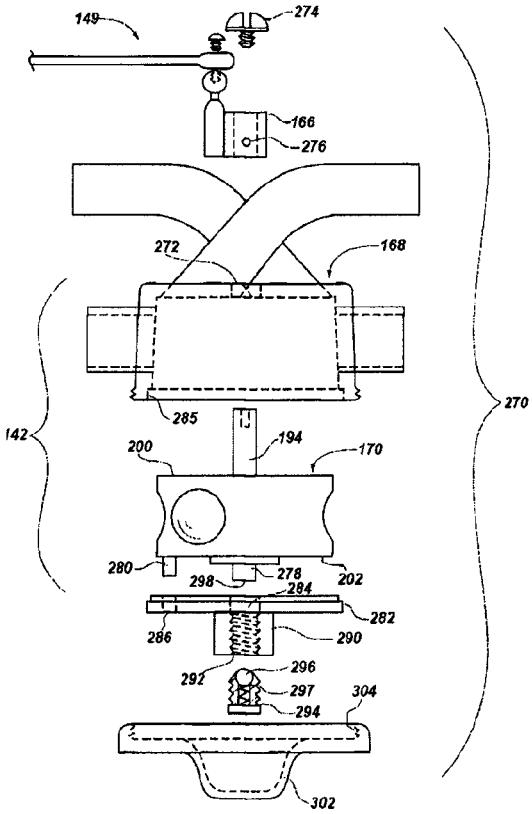
Figure 12A:
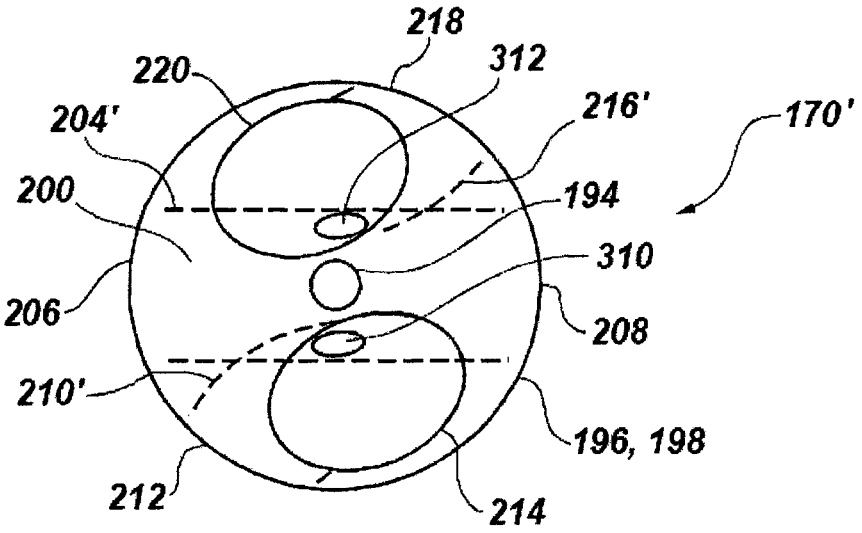

Referring now to FIGS. 12A–12C, a valve rotor 170' is shown in accordance with another embodiment of the present invention. The valve rotor 170' is configured similarly to the valve rotor 170 as described with respect to FIGS. 3 and 5 with some modifications thereto. The valve rotor 170' includes a first shaft 194 that is rigidly coupled with the rotor body 196 and may include a second, coaxial shaft coupled to the rotor body 196 on a surface opposite of the first shaft 194. The rotor body 196 is defined by an outer side surface 198, a face surface 200 and an opposing surface 202 (which may also be referred to as a second face surface). In one exemplary embodiment, and as shown in FIGS. 12A–12C, the outer side surface 198 may be formed to exhibit a substantially cylindrical geometry.

A plurality of passages is formed in the rotor body 196. A first passage 204' is formed through the rotor body 196 penetrating the outer side surface 198 to define a first opening 206 and a second opening 208 therein. In one embodiment, the first passage 204' is substantially straight with no substantial deviation between the first and second openings 206 and 208 thereof. In an exemplary embodiment, the first passage 204' may exhibit a substantially constant cross-sectional area (e.g., cylindrical) throughout the passage as taken perpendicular to a longitudinal axis thereof. The first passage 204' may act as a primary air path of a valve 142 (FIGS. 2A, 2B, and 3) having substantially no obstructions and defining a substantially unimpeded flow path when the valve 142 is in a first position as previously described herein.

A second passage 210' is defined within the rotor body 196 penetrating the outer side surface 198 to define a first opening 212 of the passage 210' and penetrating the face surface 200 to define a second opening 214 of the passage 210'. The second passage 210' exhibits a geometry that is curved about an axis, which is substantially perpendicular to the axis of rotation 197 (FIG. 3) and also curved about an axis that is substantially parallel to the axis of rotation 197. The overall curvature of the second passage 210' may be desirably maximized to provide a relatively smooth transition in the flow path partially defined thereby and to reduce turbulence or resistance in any airstream passing therethrough.

A third passage 216' is defined within the rotor body 196 penetrating the outer side surface 198 to define a first opening 218 of the passage 216' and penetrating the face surface 200 to define a second opening 220 of the passage 216'. The third passage 216' exhibits a geometry that is curved about an axis that is substantially perpendicular to the axis of rotation 197 (FIG. 3) and also curved about an axis that is substantially parallel to the axis of rotation 197. The overall curvature of the third passage 216' may also be maximized to provide a relatively smooth transition in the flow path partially defined thereby and to reduce turbulence and resistance in any airstream passing therethrough. In one embodiment, the third passage 216' may be substantially the same as, and symmetric with the second passage 210' relative to an axis of rotation.

As can be seen in FIG. 12A, the second and third passages 210' and 216' are located and configured such that small areas of interference 310 and 312 occur with the first passage 204'. In other words, since the rotor body 196 of the presently described embodiment is formed as a solid member with passages 204', 210' and 216' defined therein, the areas of interference 310 and 312, without further structure, would provide communication from each of the second passage 210' and the third passage 216' to the first passage 204'. However, as shown in FIGS. 12B and 12C, a tubing insert 314 is placed in the first passage 204' to act as a liner or a barrier between the first passage 204' and each of the second and third passages 210' and 216'.

In one embodiment, the tubing insert 314 may be formed to exhibit a substantially circular internal cross section as taken substantially transverse to its longitudinal axis. However, other configurations, such as oval, may be used. In another embodiment, the section of tubing may provide a taper, or an enlargement in cross-sectional area, as it traverses from the first opening 206 to the second opening 208 of the first passage 204'. The section of tubing insert 314 may be formed of, for example, brass tubing, although other materials may be utilized. Additionally, the tubing insert 314 desirably provides a cooperative fit with the first passage 204'. Thus, in one embodiment, the section of tubing may be press fit into the first passage 204'. In another embodiment, the section of tubing may be fixed within the first passage 204' by, for example, use of an adhesive or through other joining techniques depending on the materials being used to form the rotor body 196 and the section of tubing 314.

In one exemplary embodiment, the tubing insert 314 may be configured for subsequent removal and replacement by another section of tubing to change, for example, the cross-sectional area of the flow path defined by the tubing insert 314 and, therefore, change the resulting sound or musical presentation of the instrument in which the valve rotor 170' is installed.

Referring again to FIG. 12A, the tubing insert 314 protrudes slightly into the second passage 210' and the third passage 216' through the openings defined by the areas of interference 310 and 312. Thus, the flow path defined by the second and third passages 210' and 216' is slightly compromised by such a protrusion of the tubing insert 314. However, the effect of such protrusions into the second and third passages 210' and 216' has been determined to be minimal, particularly if the protrusions are limited in terms of volume reduction of such passages. For example, in one embodiment, the overall volume of each of the second and third passages is reduced by approximately 10% or less. In another embodiment, it may be desirable to maintain the reduction of volume of the second and third passages 210' and 216' to approximately 5% or less.

The valve rotor 170', as shown and described with respect to FIGS. 12A–12C, enables the size of the valve rotor 170' to be reduced, thereby providing a valve that is easier to manage and actuate, while providing an uncompromised primary air flow path (i.e., through the section of tubing 314 disposed in the first passage 204'), while minimally compromising a secondary flow path (i.e., through the second and third passages 210' and 216'). The valve rotor 170' also enables the customization of the primary flow path by allowing the tubing 314 to be removed and replaced by a differently configured tubing insert if desired. Moreover, the valve rotor 170' provides for a unique and efficient method of manufacturing valves and valve rotors by enabling the use of, for example, computer numerically controlled (CNC) machining to define the various passages and otherwise fabricate the rotor body 196. Such method of manufacturing valve rotors enables the consistent reproducibility thereof with improved tolerances while also reducing the laborious tasks involved with many prior valves of assembling and joining individual brass tubing components.

While the tubing insert 314 has been described with respect to the embodiments associated with FIGS. 12A–12C wherein there is interference between passages, a tubing insert 314 may also be utilized in conjunction with the embodiment shown and described with respect to FIGS. 3 and 5. The use of an interchangeable tubing insert 314 in a valve rotor enables the customization of an instrument by enabling alteration or "tuning" of the resistance introduced into the flow path.

It is noted that the valves and valve components of the above described exemplary embodiments may be subject to various modifications and may be fabricated in accordance with other manufacturing techniques. For example, the rotor body may be formed as a cast member with the various passages substantially formed therein. After such a casting is formed, the rotor body may be machined to final specifications within specified tolerances. Additionally, various portions of the valve body may be removed in a manner that does not affect the various passages while reducing the mass thereof to make a lighter component with a lower moment of inertia. In another embodiment, the face surface 200 and or opposing surface 202 need not be formed as a substantially flat surface. Rather, either surface may be formed as a curved surface. In another embodiment, one of such surfaces may be formed to exhibit substantially conical or frusto-conical geometry.

In other embodiments, the second an third passages may be formed as substantial mirror images of those described with respect to the exemplary embodiments. Such a modification enables tubing extensions to be routed differently.

Additionally, as previously noted, the present invention may be practiced in conjunction with various types of instruments, including, for example, contra-bass trombones, tubas, trumpets, fluegle horns, baritones, Tu-Bone's™, cimbassos, sousaphones and mellophones.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A valve assembly for use in a musical wind instrument comprising:

a valve housing having a substantially cylindrical side wall, a face wall coupled with the side wall, an inlet port formed in the side wall, an outlet port formed in the side wall, an extension loop entrance port formed in the face wall and an extension loop return port formed in the face wall;

a valve rotor comprising a solid body having a substantially straight first passage defined therein, a second passage defined therein, and a third passage defined therein, wherein the first passage extends from a first opening in a substantially cylindrical peripheral surface of the solid body to a second opening in the peripheral surface, wherein the second passage extends from a third opening in the peripheral surface to a first opening in a face surface of the solid body, and wherein the third passage extends from a fourth opening in the peripheral surface to a second opening in the face surface;

a tubular insert removably installed in the first passage, wherein at least one of the second passage and the third passage interferes with the first passage and wherein the tubular insert provides a barrier between the first passage and the at least one of the second passage and the third passage at a location of interference; and an actuator coupled with the valve rotor and configured to displace the solid body between a first position, wherein the first passage is aligned with the inlet port and the outlet port, and a second position, wherein the second passage is aligned with the extension loop entrance port and the third passage is aligned with the extension loop return port.

2. The valve assembly of claim 1, wherein the peripheral surface of the valve rotor body exhibits a taper between the face surface and a surface opposing the face surface.

3. The valve assembly of claim 2, wherein the valve housing defines an interior geometry configured to matingly receive the valve rotor including the taper of the peripheral surface of the valve rotor body.

4. A valve assembly for use in a musical wind instrument comprising:

a valve housing having a substantially cylindrical side wall, a face wall coupled with the side wall, an inlet port formed in the side wall, an outlet port formed in the side wall, an extension loop entrance port formed in the face wall and an extension loop return port formed in the face wall;

a valve rotor comprising a solid body having a substantially straight first passage defined therein, a second passage defined therein, and a third passage defined therein, wherein the first passage extends from a first opening in a substantially cylindrical peripheral surface of the solid body to a second opening in the peripheral surface, wherein the second passage extends from a third opening in the peripheral surface to a first opening in a face surface of the solid body, and wherein the third passage extends from a fourth opening in the peripheral surface to a second opening in the face surface;

a tubular insert removably installed in the first passage;

an actuator coupled with the valve rotor and configured to displace the solid body between a first position, wherein the first passage is aligned with the inlet port and the outlet port, and a second position, wherein the second passage is aligned with the extension loop entrance port and the third passage is aligned with the extension loop return port; and a stop member coupled to a surface of the valve rotor, a stop plate having an elongated arcuate channel formed therein sized and configured to slidably receive the stop member therethrough, wherein the stop member and the stop plate are cooperatively configured to define an angular limit of rotation of the valve rotor relative to the valve housing.

5. The valve assembly of claim 4, wherein the peripheral surface of the valve rotor exhibits a taper between the face surface and a surface opposing the face surface.

6. The valve assembly of claim 5, wherein the valve housing defines an interior geometry configured to matingly receive the valve rotor including the taper of the peripheral surface of the valve rotor.

7. A valve assembly for use in a musical wind instrument comprising:

a valve housing having a substantially cylindrical side wall, a face wall coupled with the side wall, an inlet port formed in the side wall, an outlet port formed in the side wall, an extension loop entrance port formed in the face wall and an extension loop return port formed in the face wall;

a valve rotor comprising a solid body having a substantially straight first passage defined therein, a second passage defined therein, and a third passage defined therein, wherein the first passage extends from a first opening in a substantially cylindrical peripheral surface of the solid body to a second opening in the peripheral surface, wherein the second passage extends from a third opening in the peripheral surface to a first opening in a face surface of the solid body, and wherein the third passage extends from a fourth opening in the peripheral surface to a second opening in the face surface, wherein the peripheral surface of the valve rotor body exhibits a taper between the face surface and a surface opposing the face surface and wherein the valve housing defines an interior geometry configured to matingly receive the valve rotor including the taper of the peripheral surface of the valve rotor;

a tubular insert removably installed in the first passage;

an actuator coupled with the valve rotor and configured to displace the solid body between a first position, wherein the first passage is aligned with the inlet port and the outlet port, and a second position, wherein the second passage is aligned with the extension loop entrance port and the third passage is aligned with the extension loop return port; and a biased adjustment member located and configured to apply an adjustable force to the valve rotor such that the valve rotor is biased into the valve housing.

8. A valve rotor for use in a valve of a musical wind instrument comprising:

a solid body having a substantially straight first passage defined therein, a second passage defined therein, and a third passage defined therein;

a tubular insert removably installed in the first passage;

wherein the first passage extends from a first opening in a substantially cylindrical peripheral surface of the solid body to a second opening in the peripheral surface;

wherein the second passage extends from a third opening in the peripheral surface to a first opening in a face surface of the solid body;

wherein the third passage extends from a fourth opening in the peripheral surface to a second opening in the face surface; and wherein at least one of the second passage and the third passage interferes with the first passage and wherein the tubular insert provides a barrier between the first passage and the at least one of the second passage and the third passage at a location of interference.

9. The valve assembly of claim 8, wherein the solid body is formed of a material comprising aluminum.

10. The valve assembly of claim 8, wherein the solid body is electrolessly plated with a material comprising nickel.

11. The valve assembly of claim 8, wherein the solid body is anodized.

12. A musical instrument comprising:

a first length of tubing defining a first air path, the first length of tubing extending between a first end and a second end;

a second length of tubing defining a second air path, the second length of tubing extending between a first end and a second end;

a valve assembly for use in a musical wind instrument comprising:

a valve housing having a substantially cylindrical side wall, a face wall coupled with the side wall, an inlet port formed in the side wall and coupled with the second end of the first length of tubing, an outlet port formed in the side wall, an extension loop entrance port formed in the face wall and coupled with the first end of the second length of tubing, and an extension loop return port formed in the face wall and coupled with the second end of the second length of tubing;

a valve rotor comprising a solid body having a substantially straight first passage defined therein, a second passage defined therein, and a third passage defined therein, wherein the first passage extends from a first opening in a substantially cylindrical peripheral surface of the solid body to a second opening in the peripheral surface, wherein the second passage extends from a third opening in the peripheral surface to a first opening in a face surface of the solid body, and wherein the third passage extends from a fourth opening in the peripheral surface to a second opening in the face surface;

a tubular insert removably installed in the first passage, wherein at least one of the second passage and the third passage interferes with the first passage and wherein the tubular insert provides a barrier between the first passage and the at least one of the second passage and the third passage at a location of interference; and an actuator coupled with the valve rotor and configured to displace the solid body between a first position, wherein the first passage is aligned with the inlet port and the outlet port, and a second position wherein the second passage is aligned with the extension loop entrance port and the third passage is aligned with the extension loop return port.

13. The musical instrument of claim 12, wherein the peripheral surface of the valve rotor exhibits a taper between the face surface and a surface opposing the face surface.

14. The musical instrument of claim 13, wherein the valve housing defines an interior geometry configured to matingly receive the valve rotor including the taper of the peripheral surface of the valve rotor.

15. A musical instrument comprising:

a first length of tubing defining a first air path, the first length of tubing extending between a first end and a second end;

a second length of tubing defining a second air path, the second length of tubing extending between a first end and a second end;

a valve assembly for use in a musical wind instrument comprising:

a valve housing having a substantially cylindrical side wall, a face wall coupled with the side wall, an inlet port formed in the side wall and coupled with the second end of the first length of tubing, an outlet port formed in the side wall, an extension loop entrance port formed in the face wall and coupled with the first end of the second length of tubing, and an extension loop return port formed in the face wall and coupled with the second end of the second length of tubing;

a valve rotor comprising a solid body having a substantially straight first passage defined therein, a second passage defined therein, and a third passage defined therein, wherein the first passage extends from a first opening in a substantially cylindrical peripheral surface of the solid body to a second opening in the peripheral surface, wherein the second passage extends from a third opening in the peripheral surface to a first opening in a face surface of the solid body, and wherein the third passage extends from a fourth opening in the peripheral surface to a second opening in the face surface;

a tubular insert removably installed in the first passage;

an actuator coupled with the valve rotor and configured to displace the solid body between a first position, wherein the first passage is aligned with the inlet port and the outlet port, and a second position wherein the second passage is aligned with the extension loop entrance port and the third passage is aligned with the extension loop return port; and a stop member coupled to a surface of the valve rotor, a stop plate having an elongated arcuate channel formed therein sized and configured to slidably receive the stop member therethrough, wherein the stop member and the stop plate are cooperatively configured to define an angular limit of rotation of the valve rotor relative to the valve housing.

16. The musical instrument of claim 15, wherein the peripheral surface of the valve rotor exhibits a taper between the face surface and a surface opposing the face surface.

17. The musical instrument of claim 16, wherein the valve housing defines an interior geometry configured to matingly receive the valve rotor including the taper of the peripheral surface of the valve rotor.

18. A musical instrument comprising:

a first length of tubing defining a first air path, the first length of tubing extending between a first end and a second end;

a second length of tubing defining a second air path, the second length of tubing extending between a first end and a second end;

a valve assembly for use in a musical wind instrument comprising:

a valve housing having a substantially cylindrical side wall, a face wall coupled with the side wall, an inlet port formed in the side wall and coupled with the second end of the first length of tubing, an outlet port formed in the side wall, an extension loop entrance port formed in the face wall and coupled with the first end of the second length of tubing, and an extension loop return port formed in the face wall and coupled with the second end of the second length of tubing;

a valve rotor comprising a solid body having a substantially straight first passage defined therein, a second passage defined therein, and a third passage defined therein, wherein the first passage extends from a first opening in a substantially cylindrical peripheral surface of the solid body to a second opening in the peripheral surface, wherein the second passage extends from a third opening in the peripheral surface to a first opening in a face surface of the solid body, and wherein the third passage extends from a fourth opening in the peripheral surface to a second opening in the face surface;

a tubular insert removably installed in the first passage; and an actuator coupled with the valve rotor and configured to displace the solid body between a first position, wherein the first passage is aligned with the inlet port and the outlet port, and a second position wherein the second passage is aligned with the extension loop entrance port and the third passage is aligned with the extension loop return port; and a biased adjustment member located and configured to apply an adjustable force to the valve rotor such that the valve rotor is biased into the valve housing.

19. A method of forming a valve rotor for use in a valve assembly of a musical wind instrument, the method comprising:

forming a solid body having a substantially cylindrical outer peripheral surface and a face surface;

forming a substantially straight first passage in the solid body extending from a first opening in the peripheral surface to a second opening in the peripheral surface;

forming a second passage in the solid body extending from a third opening in the peripheral surface to a first opening in the face surface;

forming a third passage in the solid body extending from a fourth opening in the peripheral surface to a second opening in the face surface;

disposing a first tubular insert exhibiting a first geometry in the first passage including press-fitting the first tubular insert into the first passage; and locating and orienting the first passage and at least one of the second passage and the third passage such that the at least one of the second passage and the third passage interferes with the first passage and, wherein disposing the first tubular insert comprises forming a barrier between the first passage and the at least one of the second passage and the third passage at a location of interference.

20. The method according to claim 19, wherein disposing a first tubular insert in the first passage includes press-fitting the first tubular insert into the first passage.

21. The method according to claim 20, further comprising removing the first tubular insert from the first passage and disposing a second tubular insert exhibiting a second geometry in the first passage.

22. The method according to claim 19, wherein forming the first passage, forming the second passage and forming the third passage includes machining the first, the second and the third passages.

23. The method according to claim 22, further including casting the solid body prior to the machining.

24. The method according to claim 19, further comprising forming the solid body of a material comprising aluminum and electrolessly plating the solid body with a material comprising nickel.

* * * * *

UNITED STATES PATENT AND TRADEMARK OFFICE

CERTIFICATE OF CORRECTION

PATENT NO. : 7,112,735 B2
APPLICATION NO. : 10/862816
DATED : September 26, 2006
INVENTOR(S) : Stephen E. Shire It is certified that error appears in the above-identified patent and that said Letters Patent is hereby corrected as shown below:

In the drawings:

FIG. 2B: Add reference numeral --100-- with appropriate arrowhead lead line in the upper left-hand corner of figure. See attached FIG. 8: Add reference numeral --290-- with appropriate lead line to the lower right-hand side. See attached FIG 12A: Change reference numeral "170" to --170'-- located in the top right-hand corner. See attached

| | | |
|---|---|---|
| COLUMN 8, | LINE 41, | change "passage is" to --passage **204** is-- |
| COLUMN 8, | LINE 52, | change "passage exhibits" to --passage **210** exhibits-- |
| COLUMN 8, | LINE 60, | change "passage may" to --passage **210** may-- |
| COLUMN 9, | LINE 6, | change "passage may" to --passage **216** may-- |
| COLUMN 9, | LINE 21, | change "passages need" to --passages 204, 210, 216 need-- |
| COLUMN 9, | LINE 25, | change "passage." to --passage **210**.-- |
| COLUMN 9, | LINES 38,39 | change "well" to --well as-- |
| COLUMN 10, | LINE 49, | change "passage to" to --passage **216** to-- |
| COLUMN 11, | LINE 12, | change "housing." to --housing **168**.-- and change "shaft is" to --shaft **194** is-- |
| COLUMN 11, | LINE 46, | change "mechanism to" to --mechanism **149** to-- |
| COLUMN 12, | LINES 42,43 | change "screw" to --screw **294**-- |
| COLUMN 12, | LINE 45, | change "screw may" to --screw **294** may-- |
| COLUMN 12, | LINE 54, | change "screw may" to --screw **294** may-- |

Signed and Sealed this
Sixteenth Day of August, 2011

David J. Kappos

David J. Kappos
*Director of the United States Patent and Trademark Office*

Replace FIG. 2B with the following amended figure:

Replace FIG. 8 with the following amended figure:

Replace FIG. 12A with the following amended figure: